US009187234B2

(12) United States Patent
Codoni

(10) Patent No.: US 9,187,234 B2
(45) Date of Patent: Nov. 17, 2015

(54) DEVICE FOR DISPENSING FOOD PRODUCTS, SUCH AS BREAD AND THE LIKE

(76) Inventor: Davide Codoni, Seriate (IT)

( * ) Notice: Subject to any disclaimer, the term of this patent is extended or adjusted under 35 U.S.C. 154(b) by 0 days.

(21) Appl. No.: 14/353,066

(22) PCT Filed: Jul. 30, 2012

(86) PCT No.: PCT/EP2012/064854
§ 371 (c)(1),
(2), (4) Date: Apr. 28, 2014

(87) PCT Pub. No.: WO2013/056866
PCT Pub. Date: Apr. 25, 2013

(65) Prior Publication Data

US 2014/0291344 A1 Oct. 2, 2014

(30) Foreign Application Priority Data

Oct. 20, 2011 (IT) ..... MI2011A1903

(51) Int. Cl.
*B67D 7/06* (2010.01)
*B65D 83/00* (2006.01)
*A47F 1/10* (2006.01)
(Continued)

(52) U.S. Cl.
CPC ..... *B65D 83/005* (2013.01); *A47F 1/10* (2013.01); *A47G 19/32* (2013.01); *A47F 2003/021* (2013.01)

(58) Field of Classification Search
CPC ..... B65D 83/005; A47F 1/10; A47F 1/08; A47F 1/03; A47F 1/02; A47G 19/32; A45F 2003/021; G07F 11/28
USPC ..... 222/185.1, 361, 409, 460, 461, 462; 221/268, 296, 263
See application file for complete search history.

(56) References Cited

U.S. PATENT DOCUMENTS 1,598,285 A * 8/1926 Klausner et al. ..... 221/40
2,182,255 A * 12/1939 Ford ..... 221/106
2,644,614 A * 7/1953 Tanko et al. ..... 222/146.5
(Continued)

FOREIGN PATENT DOCUMENTS

AT 59522 B 6/1913
AT 59522 B 6/2013
(Continued)

OTHER PUBLICATIONS

International Search Report for corresponding application PCT/EP2012/064854 filed Jul. 30, 2012; Mail date Aug. 23, 2012.
(Continued)

*Primary Examiner* — J. Casimer Jacyna
*Assistant Examiner* — Benjamin R Shaw
(74) *Attorney, Agent, or Firm* — Cantor Colburn LLP

(57) ABSTRACT

A device for dispensing food products, such as bread, comprising a container body with a front opening, which is adapted to be loaded with a food product such as bread, further comprising an inclined plane which is arranged fixed within the container body and is connected to the opening of the container body, plate-like elements being able to slide on the inclined plane and being actuatable by a lever, the plate-like elements being adapted to pass from an initial position for closing the opening of the container body to an active position in which the passage of the food product is allowed for the dispensing thereof.

10 Claims, 4 Drawing Sheets

(51) Int. Cl.

| | |
|---|---|
| ***A47G 19/32*** | (2006.01) |
| *A47F 3/02* | (2006.01) |

(56) References Cited

U.S. PATENT DOCUMENTS

| | | | | |
|---|---|---|---|---|
| 3,089,622 | A * | 5/1963 | Westlake, Jr. | 222/183 |
| 4,349,128 | A | 9/1982 | Sanfilippo | |
| 4,562,941 | A * | 1/1986 | Sanfilippo | 222/108 |
| 5,730,333 | A * | 3/1998 | Baluk et al. | 222/181.3 |
| 2001/0030202 | A1 * | 10/2001 | Hammer et al. | 222/361 |

FOREIGN PATENT DOCUMENTS

| | | | |
|---|---|---|---|
| DE | 202009006328 | U1 | 7/2009 |
| EP | 2147618 | | 1/2010 |
| EP | 2147618 | A1 * | 1/2010 |

OTHER PUBLICATIONS

Written Opinion for corresponding application PCT/EP2012/064854 filed Jul. 30, 2012; Mail date Aug. 23, 2012.

European Search Report issued Feb. 2, 2015 Re: Application No. 12 740 601.5; citing: EP 2 147 618 A1, AT 59 522 B, DE 20 2009 006328 U1 and US 4 349 128 A.

* cited by examiner

DEVICE FOR DISPENSING FOOD PRODUCTS, SUCH AS BREAD AND THE LIKE

The present invention relates to a device for dispensing food products, such as bread and the like, nuts, pasta, cereals, feedstuffs, biscuits, or candy. More specifically, the invention relates to a device for dispensing loose food products which makes it possible for the operator not to touch the foods to be withdrawn and sold to customers with his/her hands.

As is known, for example in shops, shopping malls and the like, the need is felt to be able to sell loose food products, such as bread and the like, without the sales assistant coming into contact with the foods with his/her hands.

In particular, the operator should be required to put on protective gloves when he/she comes into contact with the foods, and take them off when he/she carries out other operations. Obviously, this involves inconvenience for the operator who usually quickly abandons this practice, and touches the foods with his/her unprotected hands while at the same time also performing the other normal tasks for his/her job, with hygiene problems owing to the contact that the foods have with the operator's hands.

For example for bread, the sales assistant either puts on gloves or uses tongs to withdraw the pieces of bread from an adapted container, but still with a certain operational inconvenience.

Bread dispensers are known that make it possible for the operator to not touch the bread with his/her hands, but they suffer the drawback of being structurally complex and their size is such as to make their use difficult in small commercial enterprises.

The aim of the present invention is to provide a device for dispensing food products that makes it possible for the operator not to touch the products with his/her hands, with advantages for hygiene, and which at the same time is compact in structure.

Within this aim, an object of the present invention is to provide a device for dispensing food products that makes it possible for the operator, although not wearing adapted gloves, to withdraw the foods to be sold to customers, without touching them with his/her hands, and thus ensuring the integrity of the food product.

Another object of the present invention is to provide a device for dispensing food products, particularly bread and the like, that enables the dispensing of the foods with a simple manual movement by the operator.

Another object of the present invention is to provide a device for dispensing food products that makes it possible for users to withdraw the food product autonomously, without help from dedicated assistants and in an entirely hygienic manner.

Another object of the present invention is to provide a device for dispensing food products that is easy to disassemble and sanitize.

Another object of the present invention is to provide a device for dispensing food products that is highly reliable, easily implemented and at low cost.

This aim and these and other objects which will become better apparent hereinafter are achieved by a device for dispensing food products, such as bread and the like, comprising a container body with a front opening, which is adapted to be loaded with a food product such as bread and the like, characterized in that it comprises an inclined plane which is arranged fixed within said container body and is connected to the opening of said container body, plate-like means being able to slide on the inclined plane and being actuatable by lever means, said plate-like means being adapted to pass from an initial position for closing the opening of said container body to an active position in which the passage of said food product is allowed for the dispensing thereof.

Further characteristics and advantages of the invention will become better apparent from the description of a preferred, but not exclusive, embodiment of the device according to the present invention, which is illustrated by way of non-limiting example in the accompanying drawings, wherein.

Figure 1:
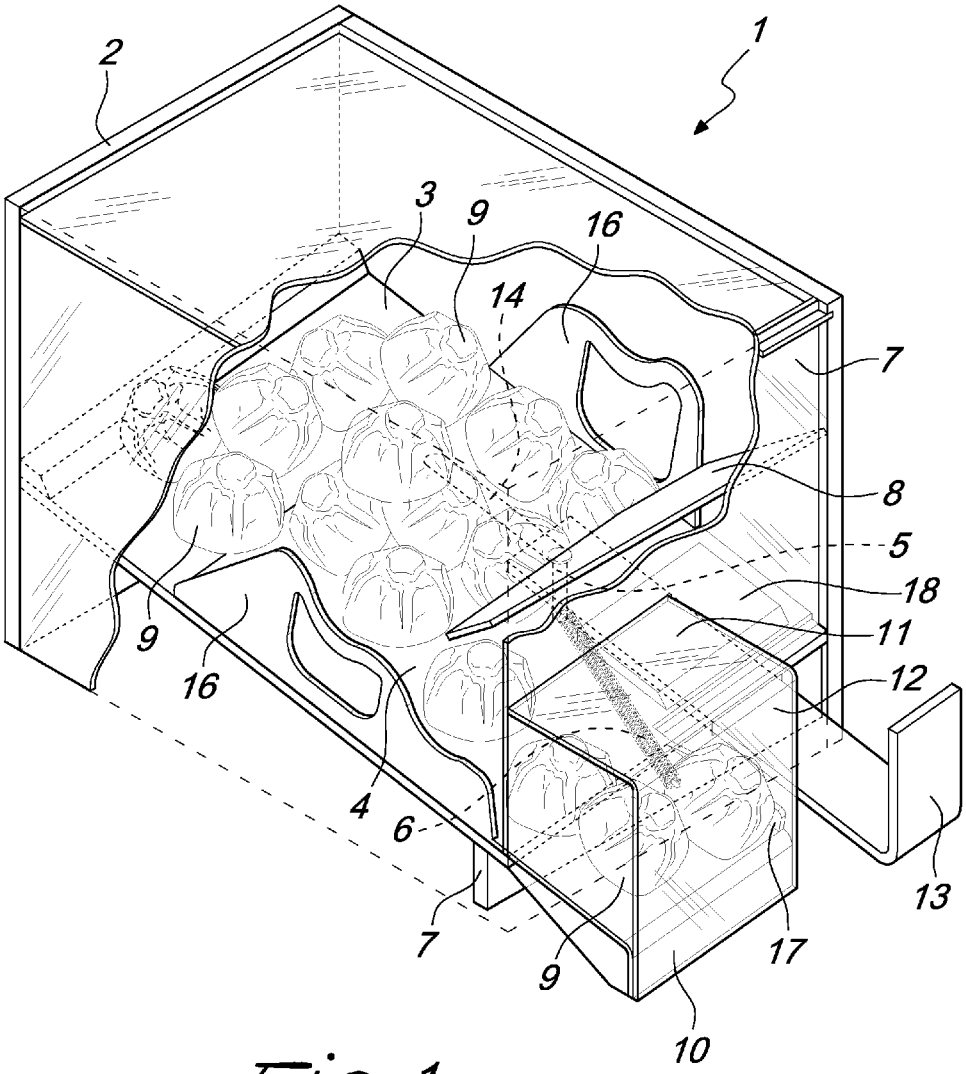
FIG. 1 is a perspective view from above of the device according to the invention.
Figure 2:
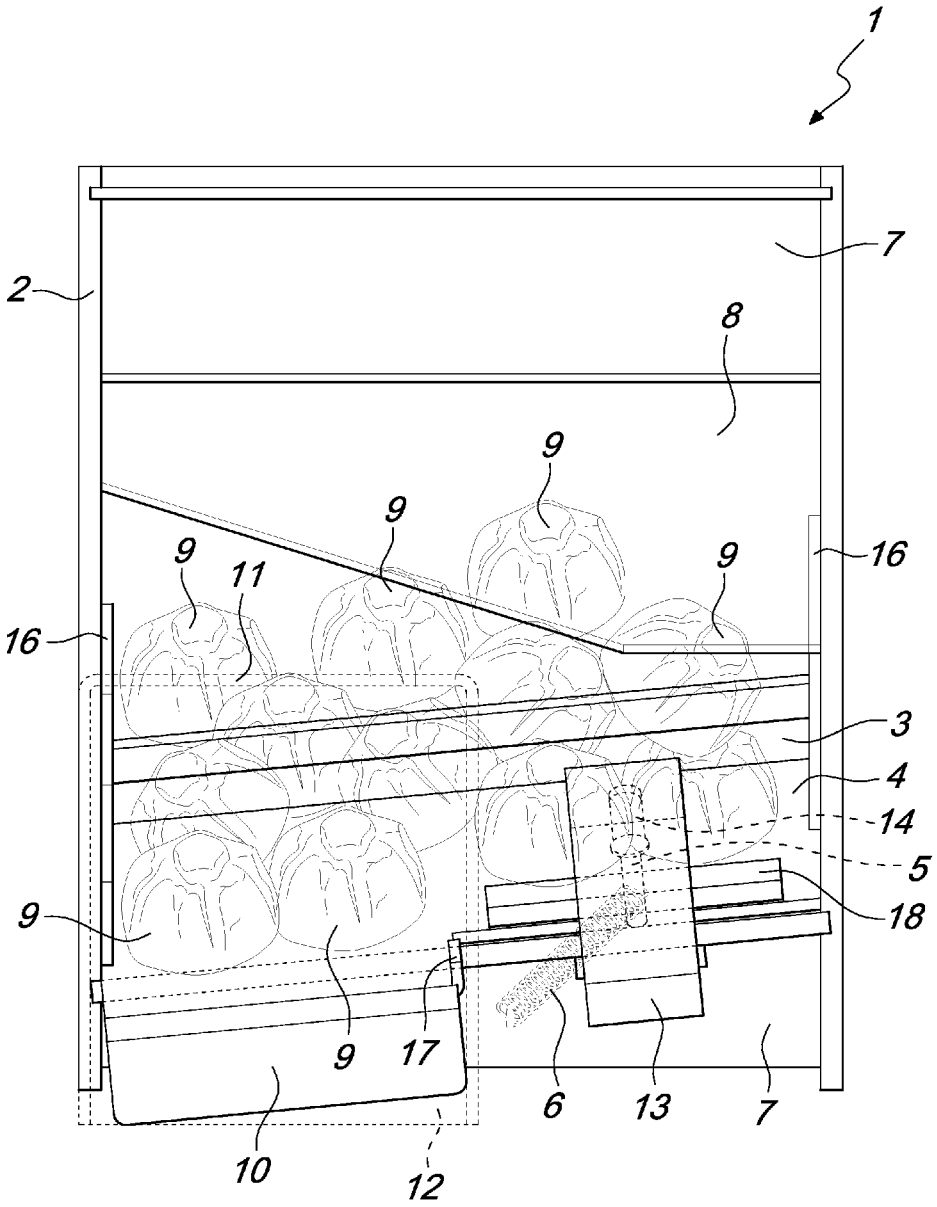
FIG. 2 is a front elevation view of the device according to the invention.
Figure 3:
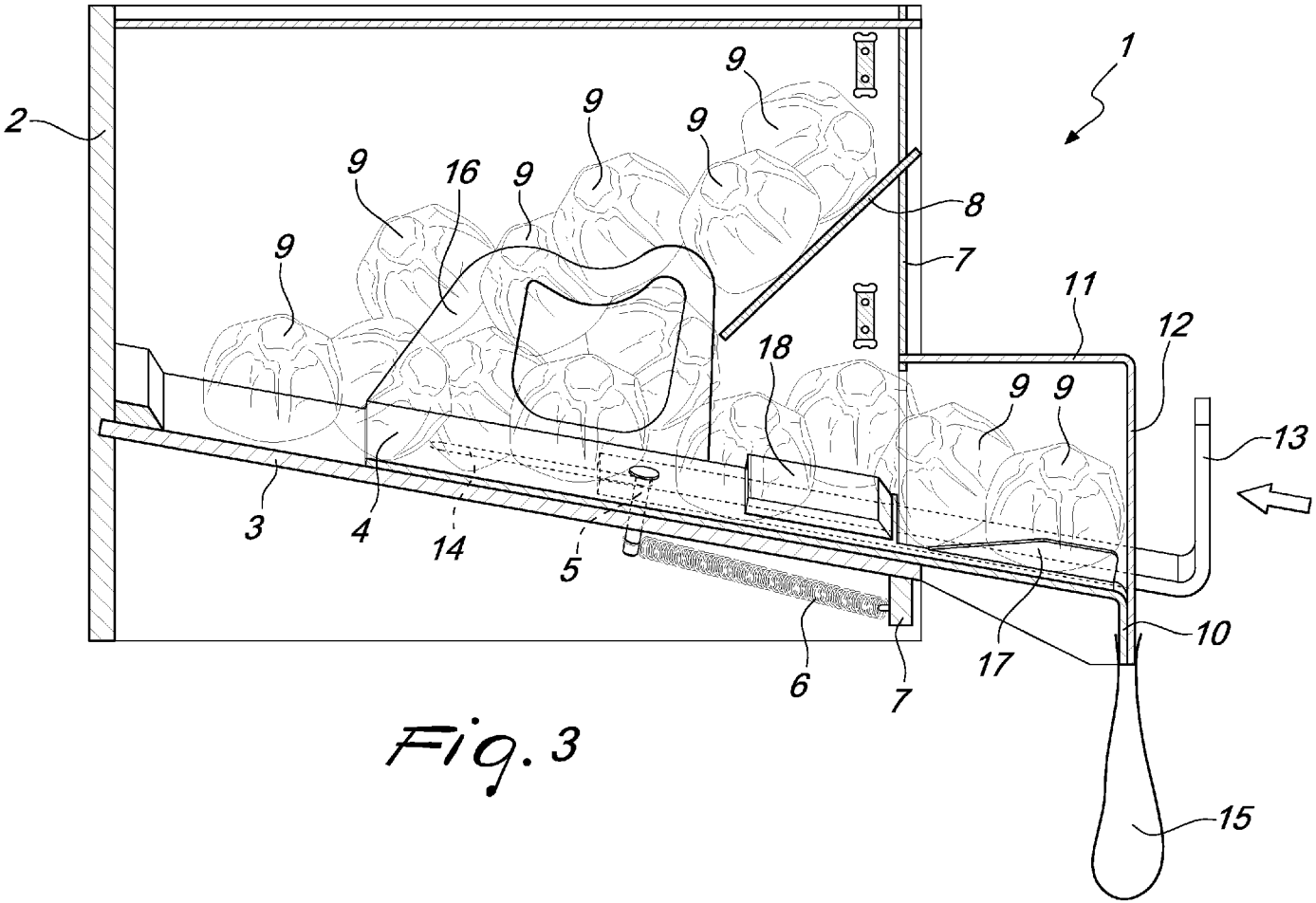
FIG. 3 is a side elevation view of the device according to the invention in a first active configuration.

With reference to the figures, the device according to the invention, generally designated by the reference numeral 1, comprises a box-like body 2 which accommodates within it a fixed inclined plane 3, which is conveniently inclined along two different axes, so as to be positioned as illustrated in FIG. 2, i.e. inclined toward the front part of the box-like body 1 and also inclined toward one side of the box-like body.

The device according to the invention moreover is provided with a plate-like element 4 (or an element that is for example concave in shape), which is adapted to be slideably overlaid on the inclined plane 3 and which is coupled to it by way of fixing means 5, which are conveniently connected by way of return means 6 to the front wall 7 of the box-like body 2.

Advantageously, the return means 6 can be constituted by a spring, the end of which is connected to the fixing means 5 and the other end of which is connected to the wall 7 of the box-like body 2.

The box-like body is moreover provided with baffle means that are adapted to enable the packaging of the food product, in this case bread 9, loaded in the box-like body 2, to be conveyed toward the inclined plane 3 and the plate-like element 4 and thus toward the exit of the box-like body 2, which is provided in the front, or anterior, wall 7 of the box-like body 2.

Conveniently, the plate-like element 4 ends with an edge portion 10 turned downward, which thus is arranged parallel to the front wall 7 of the box-like body 2.

Connected to the front wall 7 of the box-like body 2 is an L-shaped structure 11, which is arranged so that the front wall 12 of the L-shaped element is arranged parallel to the wall 7 of the box-like body 2 and parallel to the turned-down edge 10 of the plate-like element 4 and, in the first active condition, the turned-down edge 10 and the front wall 12 are adjacent.

Lever means 13 are provided for the actuation of the plate-like element 4 that slides along the inclined plane 3.

Conveniently, the lever means are able to slide within a groove 14 defined in the inclined plane 3 and are arranged between the inclined plane 3 and the plate-like element 4, with the fixing means 5 which thus fix both the lever means 13 and the plate-like element 4.

Alternatively, the lever means 13 can be provided monolithically with the plate-like element 4.

The actuation of the lever means toward the back wall of the box-like body 2, i.e. toward the wall opposite the front wall 7, ensures that the plate-like element 4 also performs a translational motion toward the back wall of the box-like body 2, sliding along the inclined plane 3, thus bringing the edge 10 from a position for contact with the front wall 12 of the L-shaped element 11 to a position in which the edge 10 is substantially in contact with the front wall 7, thus freeing a downward opening from which the food product can exit.

Figure 4:
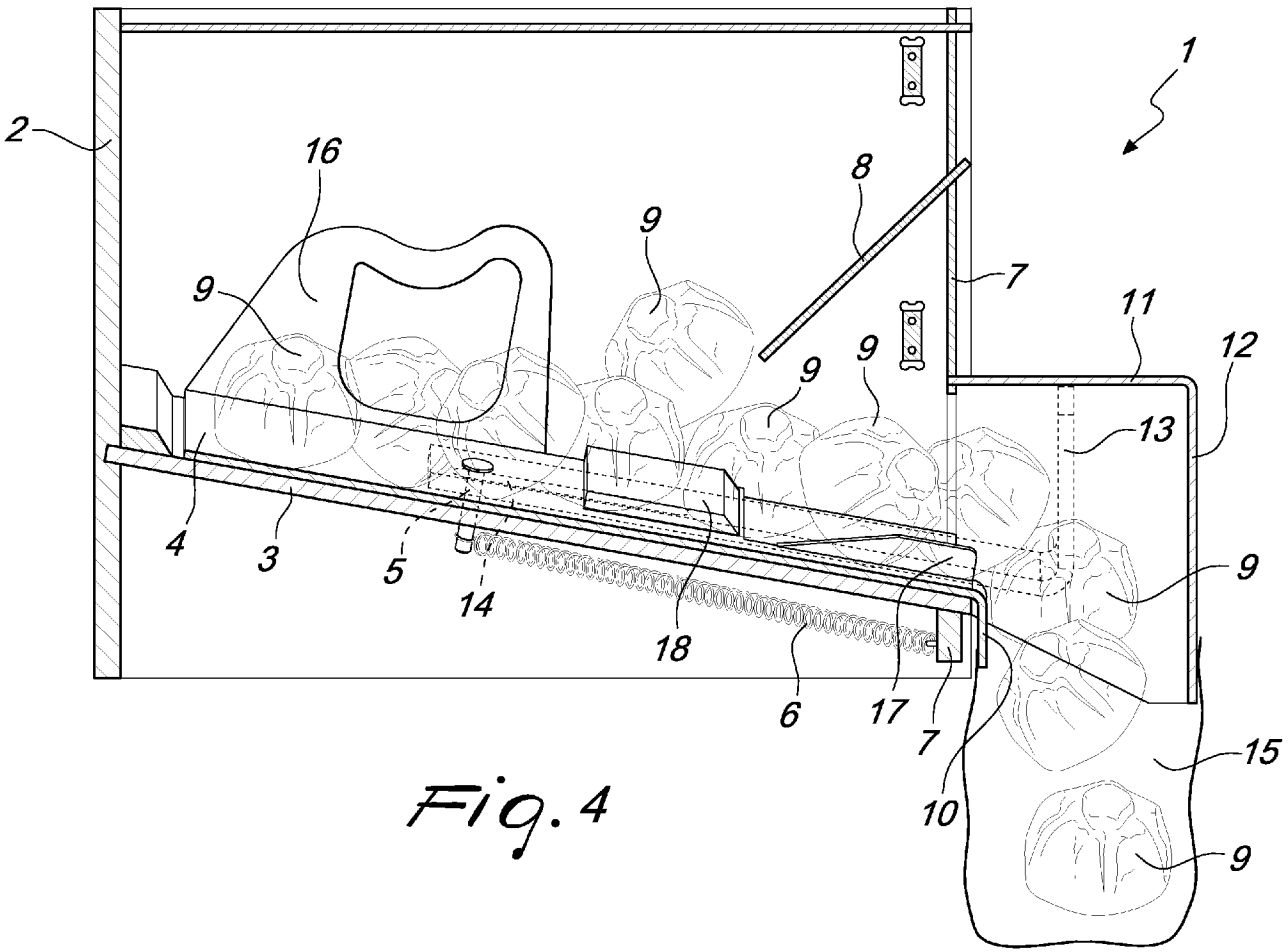
FIG. 4 is a view of a second embodiment of the device according to the invention, in a second active configuration, for dispensing of the food product.

Container means 15 are provided with mouth flaps arranged about the edge 10 and the wall 12 so that the container means 15 are in a closed condition when the edge 10 is in contact with the front wall 12 and are in an open condition, as illustrated in FIG. 4, when the edge 10, following the sliding of the plate-like element 4 along the inclined plane 3, comes into contact with the front wall 7.

Advantageously, the plate-like element 4 is provided with side walls 16 for the containment and movement of the product, arranged at the upper end of the plate-like element 4, and containment partitions 17 arranged at the lower end of the plate-like element 4, proximate to the edge 10.

Abutment means 18 are provided at the lower end of the plate-like element 4, which make it possible for the food product not to get stuck in a dead point of the container body 2, but to be conveyed, in conjunction with the presence of a deflector 8, toward the side of the plate-like element 4 that leads to the output opening of the box-like body 2 and which thus makes it possible for the food product to be made to fall by gravity into the container means 15.

Operation of the device according to the invention is clear from the foregoing description, and in particular it should be noted that the simple actuation of the lever means 13 makes it possible for the food product, loaded in the container body 2, to fall by gravity into the container means 15 in that the actuation of the lever means 13 causes the backward sliding of the plate-like element 4 and consequently the widening of the container means 15, which are ready to receive the food product.

In practice it has been found that the device according to the present invention fully achieves the intended aim and objects, in that it makes it possible to ensure the total hygiene of the food product, by preventing the operator from touching it in any way with his/her hands, while at the same time enabling the operator to provide the bread or the food product in general to the customer, without compulsorily having to put on gloves in order to be able to touch the food product with the utmost hygiene.

More specifically, the device according to the invention can enable the end consumer to directly withdraw the desired quantity of bread, in self-service mode, without the need for a dedicated assistant, the whole with a structure that is compact and relatively simple.

Moreover, the device according to the invention makes it possible to preserve the food product from contact with dust, flies and the like.

The device, thus conceived, is susceptible of numerous modifications and variations, all of which are within the scope of the appended claims.

In practice the materials employed, and the contingent dimensions and shapes, may be any according to requirements and to the state of the art.

The disclosures in Italian Patent Application No. MI2011A001903 from which this application claims priority are incorporated herein by reference.

The invention claimed is:

1. A device for dispensing food products, such as bread, comprising a container body with a front opening, which is adapted to be loaded with a food product such as bread and the like, further comprising an inclined plane which is arranged fixed within said container body and is connected to the opening of said container body, plate-like means being able to slide on said inclined plane and being actuatable by lever means, said plate-like means being adapted to pass, as a consequence of the actuation of said lever means, from an initial position for closing the opening of said container body to an active position in which the passage of said food product is allowed for the dispensing thereof, wherein said plate-like means and said lever means are pivoted by way of fixing means to said inclined plane.

2. The device according to claim 1, wherein said inclined plane is arranged within said container body so as to be inclined from the rear wall toward a front wall of the container body and also inclined toward a side wall of said container body.

3. The device according to claim 2, wherein said plate-like means and said lever means are pivoted on said inclined plane, said lever means being able to slide within a slot defined in said inclined plane in order to push said plate-like means along said inclined plane.

4. The device according to claim 2, further comprising return means which are connected between said fixing means and said front wall of said container body, for the return of said lever means to an inactive position after the actuation of said lever means by an operator.

5. The device according to claim 2, further comprising baffle means which are arranged at said front wall of said container body and are arranged obliquely toward the inside of said box-like body with respect to said front wall.

6. The device according to claim 2, wherein said plate-like means ends, at its end that protrudes from said opening of said container body, with an edge which is folded downward and is arranged adjacent to a front wall of an L-shaped element which is extended in front of said front wall of the container body.

7. The device according to claim 6, further comprising container means which are adapted to be divaricated from said edge of said plate-like means and said front wall of said L-shaped element.

8. The device according to claim 1, further comprising side walls for the containment and movement of the product, which are arranged at said plate-like means and are integral with said plate-like means, for guiding said food product toward said opening of said container body.

9. The device according to claim 3, wherein said lever means are provided monolithically with said plate-like means.

10. A device for dispensing food products, such as bread, comprising a container body with a front opening, which is adapted to be loaded with a food product such as bread, further comprising an inclined plane which is arranged fixed within said container body and is connected to the opening of said container body, plate-like means being able to slide on said inclined plane and being actuatable by lever means, said plate-like means being adapted to pass, as a consequence of the actuation of said lever means, form an initial position for closing the opening of said container body to an active position in which the passage of said food product is allowed for the dispensing thereof, wherein said inclined plane is arranged within said container body so as to the be inclined form the rear wall toward a front wall of the container body and also inclined toward a side wall of said container body, and wherein said plate-like means and said lever means are pivoted on said inclined plane, said lever means being able to slide within a slot defined in said inclined plane in order to push said plate-like means along said inclined plane.

* * * * *